US008204390B2

(12) United States Patent
Kobayashi

(10) Patent No.: US 8,204,390 B2
(45) Date of Patent: Jun. 19, 2012

(54) IMAGE FORMING APPARATUS AND METHOD FOR DETECTING THE FULLNESS OF WASTE-TONER CONTAINER

(75) Inventor: Kimihiko Kobayashi, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 432 days.

(21) Appl. No.: 12/554,370

(22) Filed: Sep. 4, 2009

(65) Prior Publication Data

US 2010/0166441 A1 Jul. 1, 2010

(30) Foreign Application Priority Data

Dec. 26, 2008 (JP) ..... 2008-332849

(51) Int. Cl.
*G03G 15/00* (2006.01)

(52) U.S. Cl. ..... 399/9; 399/13; 399/35

(58) Field of Classification Search ..... 399/9, 12, 399/13, 35
See application file for complete search history.

(56) References Cited

U.S. PATENT DOCUMENTS 5,260,755 A * 11/1993 Imaizumi ..... 399/35
7,356,269 B2 * 4/2008 Park ..... 399/35

FOREIGN PATENT DOCUMENTS

JP 2002-287595 3/2002

* cited by examiner

*Primary Examiner* — William J Royer
(74) *Attorney, Agent, or Firm* — K&L Gates LLP

(57) ABSTRACT

An image forming apparatus includes a waste-toner container, a light sensor having a light-emitting portion and a light-receiving portion, a light-blocking member for covering the light sensor to detect the attachment of the waste-toner container, and a control unit. When the waste-toner container is determined to be full based on the output voltage of the light sensor, a printing operation is stopped or is not started until it is determined that the waste-toner container is removed and then attached, and that the waste-toner container is not full. A method for detecting the fullness of a waste-toner container includes the steps of detecting the fullness of the waste-toner container, prohibiting printing, detecting whether or not the waste-toner container is attached, and permitting printing.

8 Claims, 14 Drawing Sheets

IMAGE FORMING APPARATUS AND METHOD FOR DETECTING THE FULLNESS OF WASTE-TONER CONTAINER

This application is based upon and claims the benefit of priority from the corresponding Japanese Patent application No. 2008-332849 filed Dec. 26, 2008, the entire contents of which are incorporated herein by reference.

BACKGROUND

1. Field of the Invention

The present invention relates to image forming apparatuses, such as copiers, printers, and facsimiles, and methods for detecting the fullness of waste-toner containers.

2. Description of the Related Art

In general, electrophotographic image forming apparatuses, which use toner, perform image formation (printing) by forming a toner image on a photosensitive drum, transferring the toner image to a recording medium such as a sheet, and fixing the image on the sheet. The toner that was not transferred to the recording medium (waste toner) is collected. A waste-toner container for storing the waste toner is provided in the image forming apparatus.

If the waste toner continues to be sent to the waste-toner container after the container is full, the member used to convey the waste toner (for example, a conveying screw or a conveying tube) can be damaged or the waste toner, that is unable to be stored in the container, can spill during the replacement of the waste-toner container, which may cause a problem in that the inside of the image forming apparatus becomes dirty.

Devices for detecting the fullness of a waste-toner container are known. More specifically, an image forming apparatus is known, which includes a waste toner collection bottle for storing waste toner, a movable shutter that moves to prevent the waste toner from leaking from a toner discharge port when the waste toner collection bottle is not attached to the image forming apparatus, bottle detection means for detecting the presence of the waste toner collection bottle, and toner fullness detection means that detects if the waste toner collection bottle is full with waste toner. The image forming apparatus has a projection that protrudes below the movable shutter and can be detected by the toner fullness detection means, and is configured such that the toner fullness detection means also serves as the bottle detection means. With this design, cost reductions are sought.

More specifically, by detecting whether or not the waste-toner container is filled to a predetermined level with the waste toner using a light sensor, the fullness of the waste-toner container can be detected. In general, when the waste-toner container is determined to be full, the image forming apparatus is put into a non-printable state to prevent a situation where printing is continued and waste toner continues to be fed despite the fact that the waste-toner container is full (for example, in the case during printing, the printing is aborted or no new printing job is started).

However, because the waste toner is in powder form, a cone-shaped pile of the waste toner deposited in the waste-toner container may collapse because of: vibrations applied to the image forming apparatus during printing; new waste toner that is added to the waste-toner container; weight of the waste toner and the like. In other words, the top portion of the waste toner can shift and the level of the waste toner may change. As a result, the waste toner may not block the optical path of the light sensor, which allows the image forming apparatus to determine that the waste-toner container is not full or the waste-toner container has been replaced, and to voluntarily recover from a non-printable state to the printable state (in the case during continuous printing, printing may be repeatedly aborted and restarted). This leads to a problem in that a user may misconceive that the image forming apparatus is malfunctioning or failed. The image forming apparatus set forth above does not have a countermeasure to be taken when the deposited pile of the waste toner collapses, and thus, is unable to solve the above-described problem.

Cost is reduced in the image forming apparatus by making a single sensor perform a plurality of detections. However, with the image forming apparatus, if the cover for the replacement of the waste-toner container is opened, the fullness of the waste-toner container cannot be accurately detected because of outside light, such as illumination light or solar light. Accordingly, the image forming apparatus requires a switch, or the like, to detect whether or not the cover is open, and thus, the reduction in production costs is insufficient. Furthermore, in the image forming apparatus, the detection of the fullness of the waste-toner container and the detection of the attachment of the bottle are both performed using blocking of light incident on a light-receiving portion. However, because it is impossible to clearly distinguish the situation where the waste-toner container is full and the situation where the bottle is not attached, detection performance is insufficient.

SUMMARY

An advantage of the present invention is that, while obtaining a sufficient reduction in production costs when the fullness of the waste-toner container is detected, it maintains the image forming apparatus in a non-printable state until the waste-toner container is replaced, and prevents a user from mistakenly believing the apparatus is malfunctioning.

An image forming apparatus according to an embodiment of the present invention includes an image forming section that forms an image using toner, a discharge port for discharging waste toner from the image forming section, a translucent waste-toner container having an opening for receiving waste toner discharged from the discharge port, a light sensor having a light-emitting portion and a light-receiving portion whose output voltage varies according to the amount of light received, the light-emitting portion and the light-receiving portion being arranged so as to oppose each other with the opening being located therebetween, a light-blocking member that is projectable and retractable between the light-emitting portion and the light-receiving portion, the light-blocking member being retracted when the waste-toner container is attached to the image forming apparatus and projecting to block light when the waste-toner container is removed from the image forming apparatus, a storage unit that stores an output voltage from the light-receiving portion for detecting the fullness of the waste-toner container as a first threshold and an output voltage from the light-receiving portion for detecting whether or not the light-blocking member is projected as a second threshold, and a control unit for controlling operation of the image forming section based on the output voltage of the light-receiving portion.

When the control unit has determined that the waste-toner container is full, by referencing the output voltage of the light-receiving portion and the storage unit, the control unit prohibits printing and does not permit the image forming apparatus to perform printing until the control unit detects that the light-blocking member is projected, the light-blocking member is then retracted, and the waste-toner container is not full.

A method for detecting the fullness of a waste-toner container is provided. In the method, the fullness of the waste-toner container for storing waste toner discharged from an image forming apparatus is detected using a light sensor having a light-emitting portion and a light-receiving portion. According to an embodiment of the present invention, the method includes the steps of: detecting whether or not the waste-toner container is full by comparing a first threshold, which is an output voltage of the light-receiving portion with which the waste-toner container is regarded as being full, with a received output voltage; prohibiting printing when it is determined the waste-toner container is full; detecting whether or not the waste-toner container is removed and is then attached again by providing a light-blocking member that is retracted when the waste-toner container is attached and is projected when the waste-toner container is not attached, and comparing the received output voltage with a second threshold, which is an output voltage of the light-receiving portion when the light-blocking member blocks light; and permitting printing when the attachment and removal of the waste-toner container are detected and it is determined the waste-toner container is not full.

Additional features and advantages are described herein, and will be apparent from the following Detailed Description and the figures.

BRIEF DESCRIPTION OF THE FIGURES

In the accompanying drawings:

FIG. 4B is a diagram illustrating the waste toner container of FIG. 3 in a full state.

FIG. 4C is a diagram illustrating the waste toner container of FIG. 3 with the side cover open using outside light.

DETAILED DESCRIPTION

Figure 1:
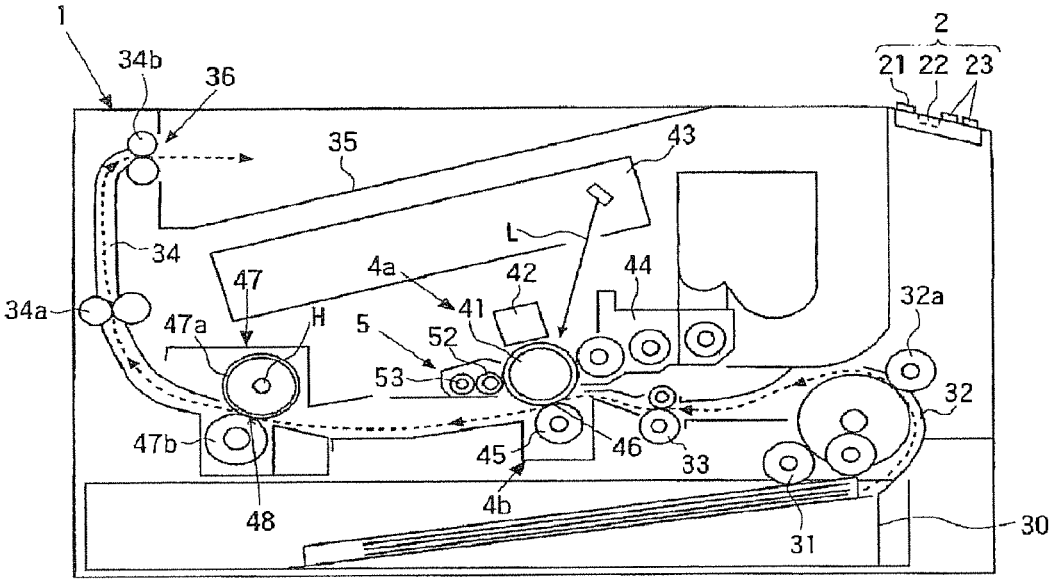
FIG. 1 is a schematic vertical cross-sectional view of an embodiment of a printer, viewed from the left.

In the following embodiments of the present invention, reference is made to the drawings. In the drawings, the same members are denoted by the same reference symbols, and redundant descriptions thereof are omitted as appropriate. Further, in the drawings, some members may be irrelevant to the description and are therefore omitted as appropriate.

Referring to FIGS. 1 to 10B, an embodiment of the present invention will be described. Note that the elements, such as the design and the arrangement, described in this embodiment are merely representative and are not intended to limit the scope of the invention.

Schematic Configuration of Image Forming Apparatus

Referring to FIG. 1, a schematic configuration of a printer 1 (e.g., an image forming apparatus) according to an embodiment of the present invention will be described. FIG. 1 is a schematic vertical cross-sectional left side view for explaining the printer 1 according to an embodiment the present invention. In FIG. 1, the right and left sides correspond to the front and back sides of the printer 1, respectively.

As shown in FIG. 1, an operation panel 2 is provided on the top surface near the front side of the printer 1. The operation panel 2 includes an indicator 21 having a plurality of light-emitting diodes (LEDs), a liquid crystal display 22, and a plurality of keys 23 for adjusting various settings. The operation panel 2 displays various messages indicating, for example, the occurrence of an error, such as the fullness of a waste-toner container 6 or a jam, and the status of the printer 1 (for example, a printable state, an error state, and printing status, such as, printing or completion of printing) with the indicator 21 and the liquid crystal display 22 (for example, blinking or turning on of the indicator 21 and display of a message on the liquid crystal display 22). Furthermore, using the keys 23, various operations and settings relating to the printer 1 can be performed, for example, selection of a sheet size to be used.

As shown in FIG. 1, the printer 1 accommodates a cassette 30 for feeding sheets at the bottom of a main body; the sheets are stacked in the cassette 30. The sheets are fed towards the right side above the cassette 30 in FIG. 1 by a feeding roller 31 that is driven by a driving unit (not shown), such as a motor.

A sheet conveying path 32 (a conveying roller pair 32*a*), a register roller pair 33, an image forming section 4*a*, and a transferring section 4*b* are arranged on the downstream side of the cassette 30 in the sheet feeding direction. A sheet fed from the cassette 30 passes through the sheet conveying path 32 to the register roller pair 33. The register roller pair 33 corrects the orientation of the sheet, if the sheet is fed in a skewed manner, and feeds the sheet to the transferring section 4*b*, so as to match the timing with the formation of a toner image at the image forming section 4*a*.

The image forming section 4*a* forms an image with toner. The toner image, formed by the image forming section 4*a*, is transferred to the sheet by the transferring section 4*b*. More specifically, the image forming section 4*a* includes a photosensitive drum 41, functioning as a toner image carrier, having a substrate made of a metal, such as aluminum, and a photosensitive layer on the substrate, which is made of amorphous silicon or organic photo conductor (OPC).

An image formation (toner image formation) process will now be described. First, a charging device 42 located above the photosensitive drum 41 charges the photosensitive drum 41 at a predetermined potential utilizing a corona discharge. The charging device 42 may alternatively use a charging roller or a charging brush. Then, according to image data sent from a user's terminal 100 (see FIG. 7) to the printer 1, laser light L controlled by an exposure unit 43 located above the image forming section 4*a* is emitted onto the photosensitive drum 41. As a result, an electrostatic latent image corresponding to the image data is formed on the photosensitive drum 41. Then, a developing unit 44 located on the right side of the photosensitive drum 41 in FIG. 1 supplies toner to the electrostatic latent image, whereby a toner image is developed.

As the photosensitive drum 41 rotates, the toner image enters a transferring nip portion 46 provided between the photosensitive drum 41 and a transfer roller 45 of the transferring section 4*b*. At the same time, the register roller pair 33 feeds the sheet to the transferring nip portion 46, and a voltage having a polarity that is opposite to that of the toner is applied to the transfer roller 45. Thus, the toner image is transferred to the sheet.

A cleaning unit 5 is positioned on the left side of the photosensitive drum 41 in FIG. 1. The cleaning unit 5, which extends parallel to the axis of the photosensitive drum 41, removes deposits and the residual toner that is left untransferred (hereinafter, "waste toner 51") from the photosensitive drum 41. The cleaning unit 5 has a scrubbing roller 52 that is in contact with the photosensitive drum 41. When the toner image is formed, the scrubbing roller 52 rotates in the same direction as the photosensitive drum 41 to scrub the surface of the photosensitive drum 41 to remove the residual toner and deposits. Instead of the scrubbing roller 52, a cleaning brush or a resin blade may be abutted against the photosensitive drum 41 to clean the photosensitive drum 41.

A waste-toner conveying member 53, extending parallel to the axis of the scrubbing roller 52, is provided to the left of the scrubbing roller 52 in FIG. 1. The waste-toner conveying member 53 has screw-shaped or spiral-shaped blades, and rotates when the toner image is formed and the like. The rotation of the waste-toner conveying member 53 feeds the waste toner 51 which was removed from the photosensitive drum 41 by the scrubbing roller 52 in a direction perpendicular to the plane of the sheet of FIG. 1 (the directions of the left and right surfaces of the printer 1). Then, the waste toner 51 is finally collected and stored in the waste-toner container 6. This process will be described in detail below.

A fixing unit 47 for applying heat and pressure to the sheet to which the toner image has been transferred, a sheet conveying path 34 (an output roller pair 34*a* and an output roller pair 34*b*), and an output tray 35 are located on the downstream side of the image forming section 4*a* and the transferring section 4*b*, in the sheet feeding direction. The sheet to which the toner image has been transferred at the transferring section 4*b* is sent to the fixing unit 47. The fixing unit 47 includes a heating roller 47*a* containing a heater H and a pressing roller 47*b* urged against the heating roller 47*a* to form a fixing nip portion 48 therebetween. When the sheet enters the fixing nip portion 48, the toner image is fixed on the sheet. The sheet outputted from the fixing unit 47 is sent upwards through the sheet conveying path 34 and is outputted from a sheet output portion 36 onto the output tray 35 provided on the top of the main body. Thus, image formation (printing) on one sheet is completed.

Configurations of the Waste-Toner Container and Peripheral Components

The printer 1 according to an embodiment of the present invention can perform three detections, namely, detecting whether or not the waste-toner container 6 is full, detecting whether or not the waste-toner container 6 is attached to the printer 1, and detecting whether or not a side surface cover 1*a* provided for the replacement of the waste-toner container 6 is open, using a light sensor 7. Now, configurations of the waste-toner container 6 and the peripheral components, such as the light sensor 7 (FIG. 7), will be described with reference to FIGS. 2 to 6.

Figure 2:
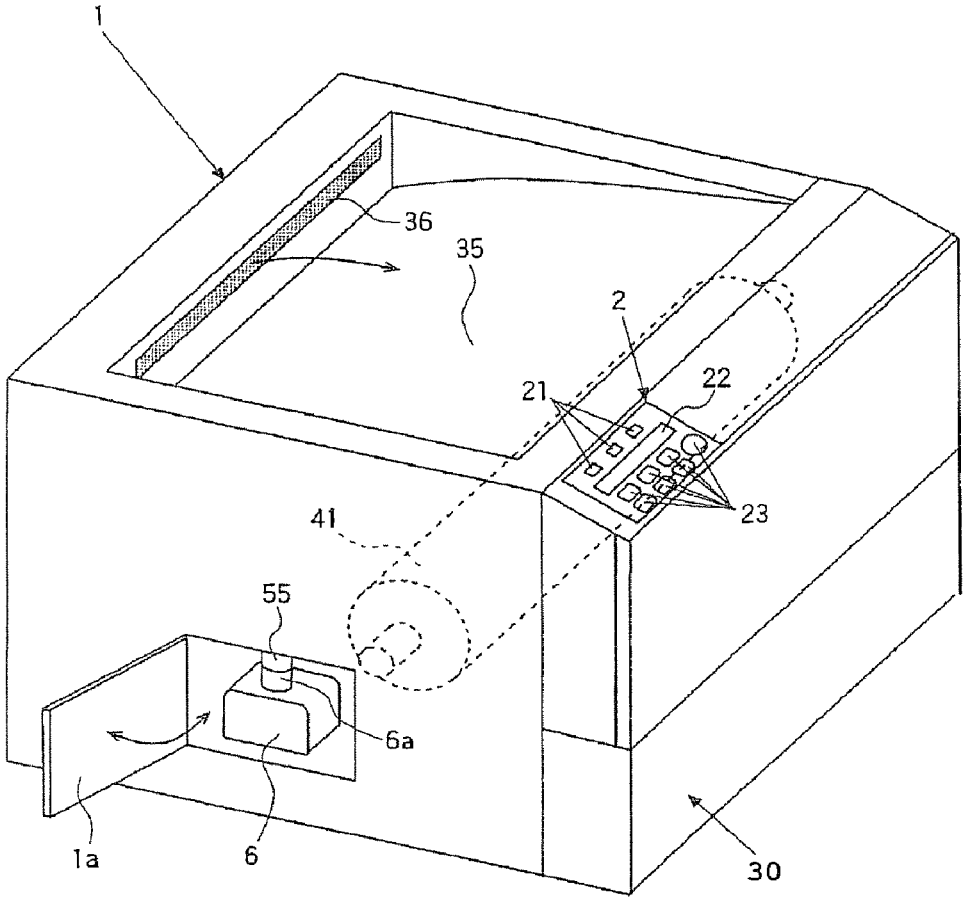
FIG. 2 is a perspective view of the printer of the embodiment of FIG. 1, viewed from the upper left.
Figure 3:
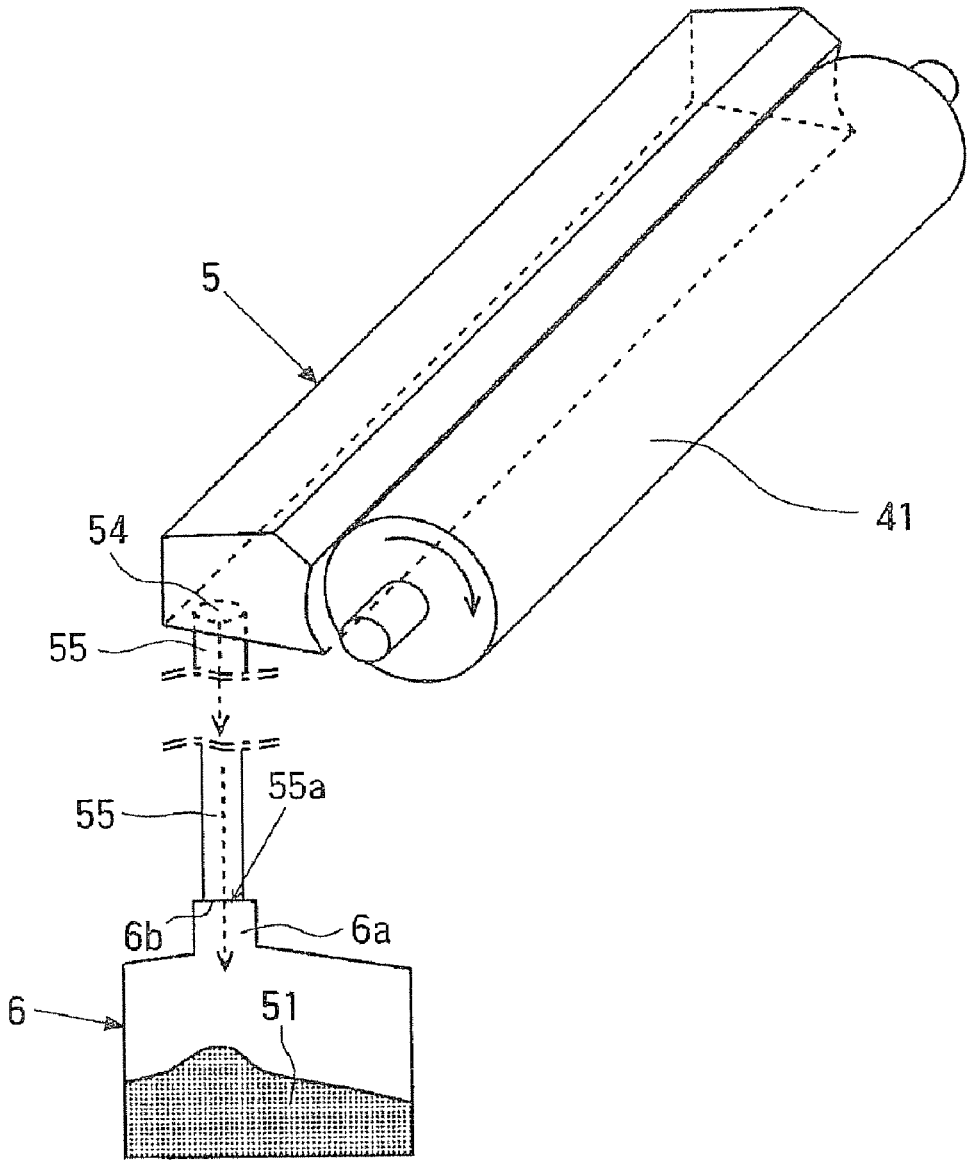
FIG. 3 is a diagram of a waste-toner collection mechanism according to an embodiment of the present invention.
Figure 4A:
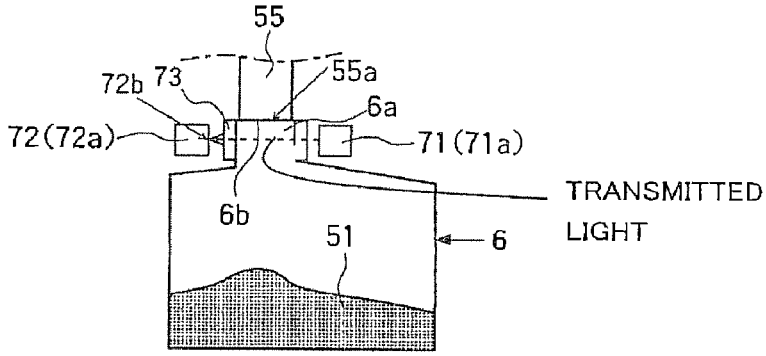
FIGS. 4A, 4B, and 4C are diagrams for explaining the detection of the fullness of a waste-toner container according to the embodiment of FIG. 3, illustrating the detection of a non-full state, a full state, and whether or not a side surface cover is open using outside light, respectively.
Figure 4B:
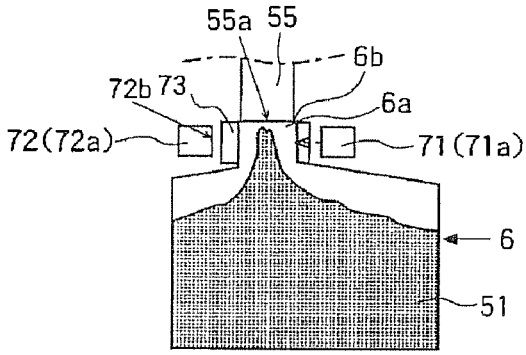
Figure 4C:
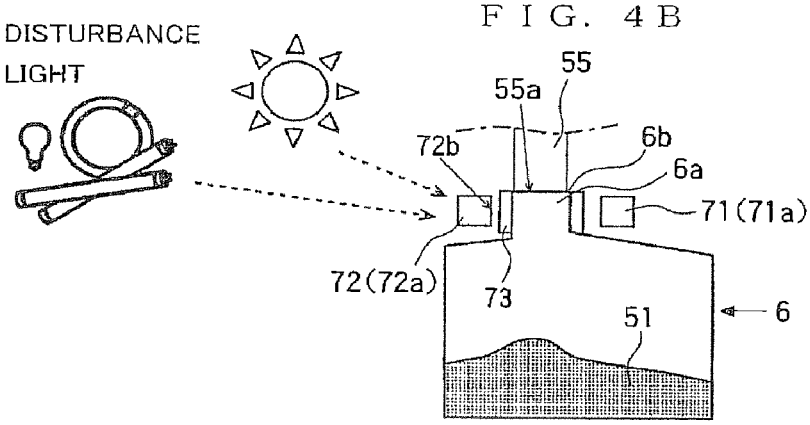
Figure 5A:
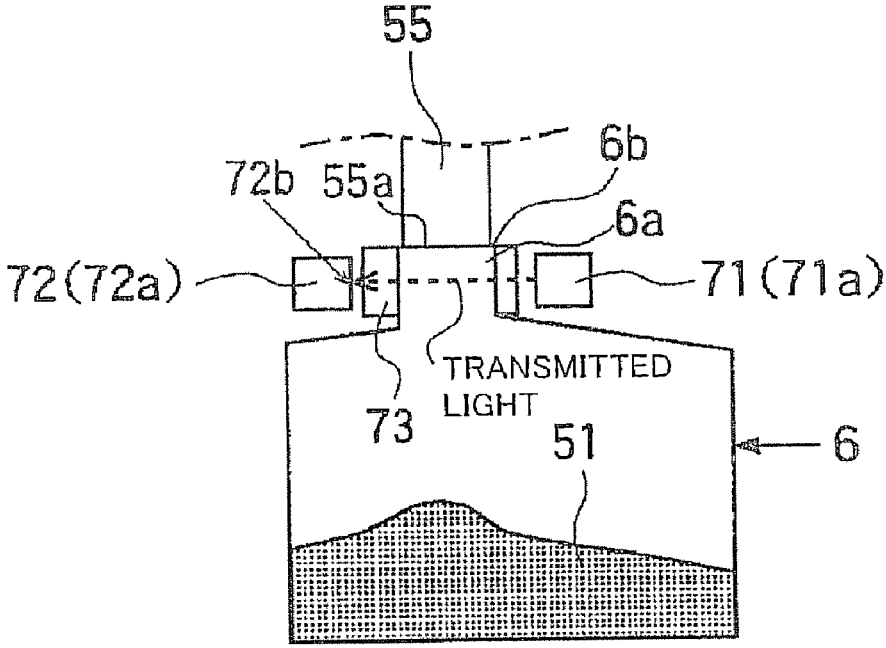
FIG. 5A is a diagram illustrating the movement of the light blocking member according to an embodiment.
Figure 5B:
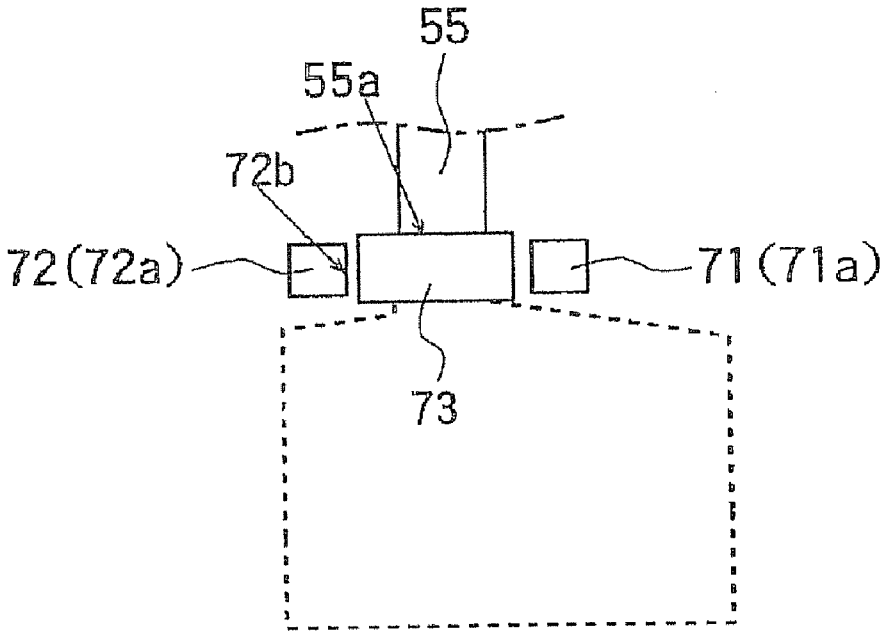
FIG. 5B is a diagram illustrating the movement of the light blocking member according to an embodiment.
Figure 6:
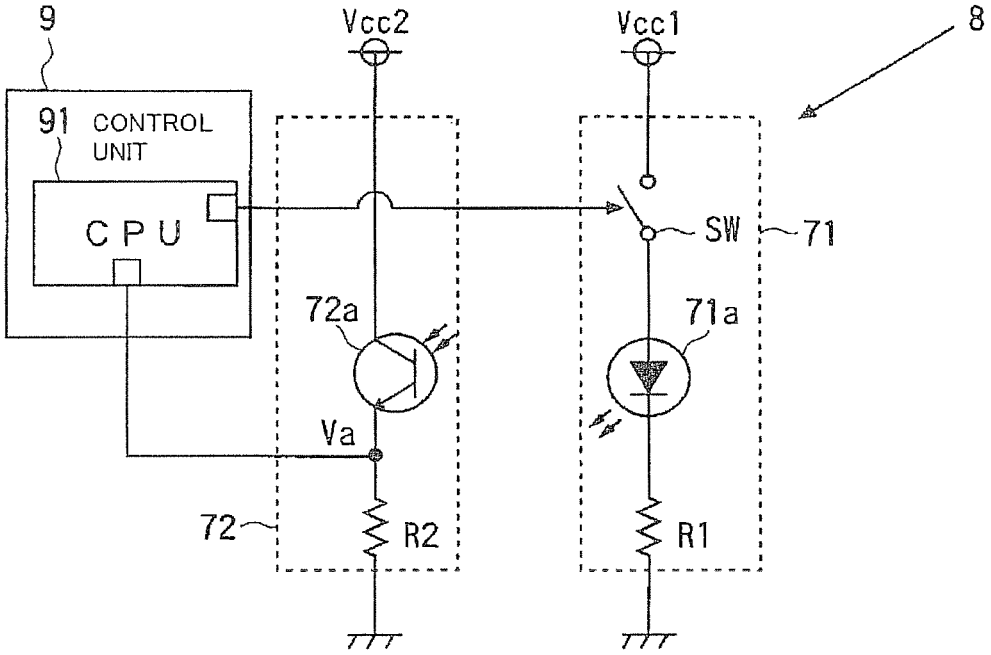
FIG. 6 is a circuit diagram showing a circuit of a light sensor according to an embodiment of the present invention.

FIG. 2 is a perspective upper left view of the printer 1 according to an embodiment of the present invention. FIG. 3 is a diagram for explaining an example of a waste-toner collection mechanism according to an embodiment of the present invention. FIGS. 4A, 4B, and 4C are diagrams for explaining the detection of the fullness of the waste-toner container 6 according to an embodiment, showing the detection of a non-full state, a full state, and whether or not the side surface cover 1*a* is open, using outside light, respectively. FIGS. 5A and 5B are diagrams for explaining the movement of a light-blocking member 73 according to an embodiment. FIG. 6 is a circuit diagram showing a circuit of the light sensor 7 according to an embodiment.

First, as shown in FIG. 2, the printer 1 according to an embodiment has a side surface cover 1*a*, which is a cover that is capable of being opened and closed, as a part of a casing of the apparatus (the solid arrow shows the directions in which the side surface cover 1*a* is opened and closed). The waste-toner container 6 is attached so that it is exposed to the outside when the side surface cover 1*a* is open. In other words, the waste-toner container 6 is attached to the inside of the left side surface of the printer 1. When the waste-toner container 6 is determined to be full and is to be replaced, a user opens the side surface cover 1*a* of the printer 1 and removes the waste-toner container 6 from the printer 1, and then positions a new waste-toner container 6.

The rotary body shown by a dashed line in FIG. 2 is the photosensitive drum 41. Since the positions to locate the photosensitive drum 41 and the waste-toner container 6 are limited, they are normally located such that the outside light is incident on the photosensitive drum 41 when the side surface cover 1*a* is open. The solid arrow shown above the printer 1 in FIG. 2 indicates a direction in which the printed sheet is outputted.

Referring to FIG. 3, the waste-toner collection mechanism according to an embodiment of the present invention will now be described. In FIG. 3, for convenience's sake, components other than the photosensitive drum 41 and the cleaning unit 5 of the image forming section 4*a* are omitted.

As shown in FIG. 3, the cleaning unit 5 is provided in parallel with the axis of the photosensitive drum 41. The cleaning unit 5 has, as described with reference to FIG. 1, the scrubbing roller 52 and the waste-toner conveying member 53 (not shown in FIG. 3) extending parallel to the axis of the photosensitive drum 41. The lower surface of the cleaning unit 5 has, at one end thereof, a hole 54 for discharging the waste toner 51 from the cleaning unit 5. A conveying tube 55, for discharging the waste toner 51 in the cleaning unit 5, is connected to the hole 54. Alternatively, the waste toner 51 may be discharged from the cleaning unit 5 utilizing a vacuum device (not shown).

The waste-toner conveying member 53 feeds the waste toner 51 in the cleaning unit 5 toward the hole 54 and the conveying tube 55, and the waste toner 51 is discharged from the cleaning unit 5 to the conveying tube 55. The conveying tube 55 has, at the other end, a discharge port 55*a*, from which the waste toner 51 from the image forming section 4*a* is discharged. The waste-toner container 6 is connected to the discharge port 55*a*. This configuration allows the waste toner 51 to fall into the waste-toner container 6.

Referring to FIGS. 4A-4C, 5A and 5B, the configuration of the waste-toner container 6 and the light sensor 7 according to an embodiment of the present invention will be schematically described. First, the configuration of the waste-toner container 6 will be described in detail. The waste-toner container 6 of the printer 1 according to this embodiment has a cylindrical projection 6*a* at the top thereof. The projection 6*a* has an opening 6*b* at the top, and the waste toner 51 is introduced into the waste-toner container 6 from the opening 6*b*. The waste-toner container 6 is made of a translucent (for example, transparent or semi-transparent) resin. That is, the waste-toner container 6 is translucent and includes the opening 6*b* through which the waste toner 51 discharged from the discharge port 55*a* of the conveying tube 55 is stored.

The light sensor 7 according to this embodiment includes a light-emitting portion 71 and a light-receiving portion 72 whose output voltage Va changes according to the amount of light received. The light-emitting portion 71 and the light-receiving portion 72 are arranged so as to oppose each other with the opening 6*b* (projection 6*a*) being therebetween, at the position where the waste-toner container 6 is attached. The light-emitting portion 71 of the light sensor 7 includes a light source (for example, an LED 71*a*) and emits light to the light-receiving portion 72. On the other hand, the light-receiving portion 72 includes a light-receiving element that generates electric current upon receipt of light. Examples of the light-receiving element include a phototransistor and a photodiode (in this embodiment, a phototransistor 72*a* is used).

Now, referring to FIG. 6, a circuit of the light sensor 7 for the various detections will be described. A detection circuit 8 of the light sensor 7, shown in FIG. 6, includes the light-emitting portion 71 and the light-receiving portion 72 of the light sensor 7. The LED 71*a* is provided in the light-emitting portion 71 of the light sensor 7. A resistor R1 for limiting electric current is connected to the cathode of the LED 71*a*. The other end of the resistor R1 is connected to the ground. The anode of the LED 71*a* is connected to a switch SW that functions as the on/off control. The switch SW is connected to a power source Vcc1. A control unit 9 (central processing unit (CPU) 91) performs the on/off control of the LED 71*a* by controlling the on/off operation of the switch SW (this will be described in detail below. See FIG. 7).

The light-receiving portion 72 has the phototransistor 72*a* that functions as a light-receiving element. The emitter of the phototransistor 72*a* is connected to a resistor R2 for converting the output electric current of the phototransistor 72*a* into voltage. The other end of the resistor R2 is connected to the ground. A power source Vcc2 is connected to a collector of the phototransistor 72*a*. A voltage Va between the emitter of the phototransistor 72*a* and the resistor R2 is inputted to the port of the CPU 91 as the output voltage Va of the light sensor 7 (light-receiving portion 72). The CPU 91 performs an A/D conversion on the output voltage Va to identify the magnitude thereof. An A/D converter may be provided between the port of the CPU 91 and the light-receiving portion 72 so that the digital value is inputted to the CPU 91.

Because the amount of electric current flowing from the phototransistor 72*a* changes according to the amount of light received by the phototransistor 72*a*, the CPU 91 confirms the magnitude of the output voltage Va to identify the amount of light incident on the light-receiving portion 72, and detects whether or not: the waste-toner container 6 is full; the side surface cover 1*a* is open; and the waste-toner container 6 is attached to the printer 1. Note that, for example, the power sources Vcc1 and Vcc2 are supplied with electric power from a power source unit 94 provided in the printer 1 (see FIG. 7). The power source unit 94 is connected to a commercial power source, rectifying and stepping down the voltage to supply electric power to the respective parts in the printer 1.

Next, referring to FIGS. 4A to 4C, the various detections using the light sensor 7 according to an embodiment will be described.

Detection of the Fullness of Waste-Toner Container

First, the detection of the fullness of the waste-toner container 6 will be described. FIG. 4A shows a non-full state, wherein the light from the light-emitting portion 71 passes through the waste-toner container 6, due to the transparency of the waste-toner container, and reaches the light-receiving portion 72 (transmitted light). FIG. 4B shows a full state, wherein, as a result of the waste toner 51 falling from the opening 6*b* being deposited in a cone-shaped pile, the waste toner 51 blocks part of the optical path from the light-emitting portion 71 to the light-receiving portion 72. There is a difference in the output of the light-receiving portion 72 between a non-full state shown in FIG. 4A and the fullness state shown in FIG. 4B. For example, if the output voltage Va of the light-receiving portion 72 is small, when the side surface cover 1*a* is closed and the light-emitting portion 71 emits light, the waste-toner container 6 can be determined to be full.

Figure 9:
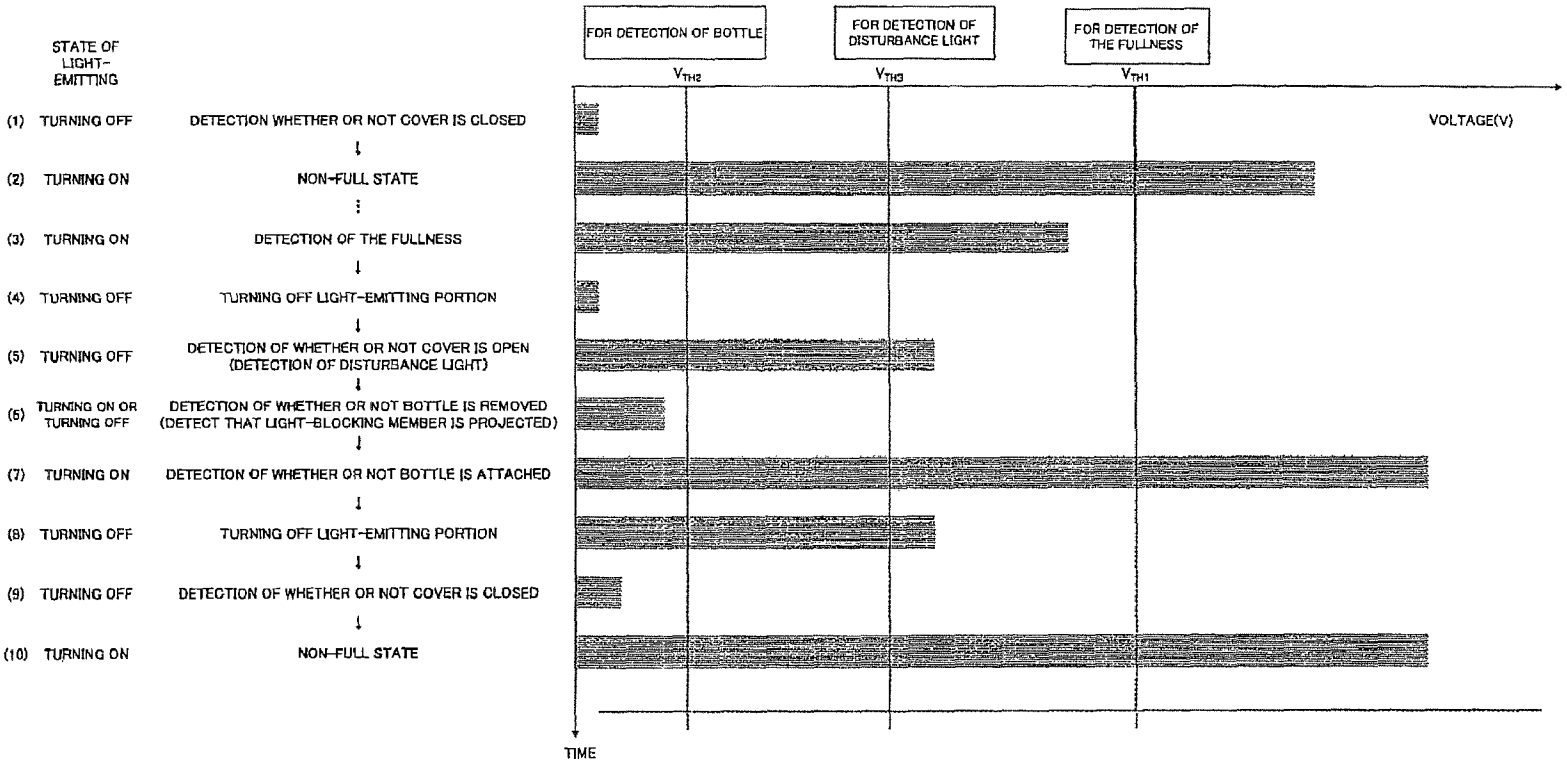
FIG. 9 shows a relationship between thresholds used for the various detections in the printer and output voltages Va of a light-receiving portion, according to an embodiment.

In the printer 1 according to this embodiment, a storage unit 93 stores a threshold Vth1, for detecting whether or not the waste-toner container 6 is full, with respect to the output voltage Va of the light-receiving portion 72 (see FIG. 9). Then, the CPU 91 (control unit 9) compares the output voltage Va with the threshold Vth1, to determine whether or not the waste-toner container 6 is full. If printing is performed when the waste-toner container 6 is full, the components may be damaged. Thus, when it is determined the waste-toner container 6 is full, the control unit 9 puts the printer 1 into a non-printable state. Specifically, in the non-printable state, sheet feeding and image formation (toner image formation, feeding of the waste toner 51, and the like) are not performed.

Detection of Whether or Not the Side Surface Cover is Open

FIG. 4C shows a state in which the side surface cover 1*a* is open and the outside light is incident on the light-receiving portion 72. Because the printer 1 is usually installed indoors, examples of the outside light include: solar light entering through windows; and illumination light, such as fluorescent lamps and desk lamps in the room. Even when the waste-toner container 6 is full, the outside light incident on the light-receiving portion 72 may make it impossible to distinguish the output of the light-receiving portion 72 from that in a non-full state. Accordingly, the fullness detection of the waste-toner container 6 should be performed in a state wherein the side surface cover 1*a* is closed and no outside light is incident on the light-receiving portion 72.

Whether or not the side surface cover 1*a* is open can be determined by confirming whether or not the output of the light-receiving portion 72 is greater than that in the state when the light-emitting portion 71 emits no light with that in a no-light state (when the side surface cover 1*a* is closed). Thus, in the printer 1 according to this embodiment, the storage unit 93 stores a threshold Vth3 for detecting whether or not the side surface cover 1*a* is open with respect to the output voltage Va of the light-receiving portion 72 (see FIG. 9). Then, the CPU 91 (control unit 9) compares the output voltage Va with the threshold Vth3 to determine whether or not the side surface cover 1*a* is open.

Detection of Whether or not the Waste-Toner Container is Attached

Referring to FIGS. 5A and 5B, an example of detecting whether or not the waste-toner container 6 is attached to the printer 1, according to an embodiment of the present invention, will be described. The printer 1 according to this embodiment is put into a non-printable state when it is determined the waste-toner container 6 is full. Then, a user removes the full waste-toner container 6 from the printer 1 and replaces it with a new waste-toner container 6. If the printer 1 is returned to a printable state when the waste-toner container 6 is not attached to the printer 1 (before the replacement is completed), the waste toner 51 spills out of the conveying tube 55, soiling the inside of the printer 1 and the portions around the side surface cover 1*a*. Therefore, the detection of whether or not the waste-toner container 6 is attached to the printer 1 is necessary.

In the printer 1 according to this embodiment, whether or not the waste-toner container 6 is attached to the printer 1 is detected using the light sensor 7 and the light-blocking member 73. In the printer 1 according to this embodiment, as shown in FIG. 5A, the light-blocking member 73 is retracted to a first position when the waste-toner container 6 is attached to the printer 1, and, as shown in FIG. 5B, the light-blocking member 73 is projected to the near side (to a second position) with respect to the plane of the sheet of FIG. 5B, when the waste-toner container 6 is removed from the printer 1.

More specifically, in the example of FIGS. 5A and 5B, the light-blocking member 73 is urged forward with respect to the plane of the sheet of FIGS. 5A and 5B by an elastic member such as a spring (not shown). When the waste-toner container 6 is attached to the printer 1, the projection 6*a* is brought into contact with the light-blocking member 73. When the waste-toner container 6 is attached to the printer 1, so as to be fixed by a supporting member (not shown), the light-blocking member 73 is pressed backwards to a retracted position (to the first position) shown in FIG. 5A with respect to the plane of the sheet of FIGS. 5A and 5B. Thus, the light-blocking member 73 does not block the optical path from the light-emitting portion 71 to the light-receiving portion 72. On the other hand, when the waste-toner container 6 is removed from the printer 1, the light-blocking member 73 is urged by the elastic member to project frontward (to the second position), blocking the optical path from the light-emitting portion 71 to the light-receiving portion 72. In short, when the waste-toner container 6 is attached to the printer 1, the light-blocking member 73 is retracted, and, when the waste-toner container 6 is removed from the printer 1, the light-blocking member 73 projects to the second position and covers the light-receiving surface 72*b* of the light-receiving portion 72, blocking the light from the light-emitting portion 71 to the light-receiving portion 72. Because the light-blocking member 73 shuts the discharge port 55*a* of the conveying tube 55, the light-blocking member 73 also functions as a shutter for the conveying tube 55.

The light-blocking member 73 is made of, for example, resin and has a quadrangular-prism-shape. When the light-blocking member 73 is projected to the second position, one of the side surfaces thereof covers the light-receiving surface 72*b* of the light-receiving portion 72, blocking the optical path from the light-emitting portion 71 to the light-receiving portion 72. Therefore, only the light entering the gap between the light-blocking member 73 and the light-receiving portion 72 is incident on the light-receiving surface 72*b*, which is substantially less than the light from the light-emitting portion 71 emitted onto the light-receiving surface 72*b* or the outside light when the light-blocking member 73 is retracted.

Accordingly, if the output voltage Va of the light-receiving portion 72 is extremely small when the light-emitting portion 71 emits light (the light-emitting portion 71 may not emit light) after it is detected that the side surface cover 1*a* is open, it can be determined that the light-blocking member 73 is projected to the second position (the waste-toner container 6 has been removed). Furthermore, in order for the output voltage Va of the light-receiving portion 72 to increase after it is detected that the waste-toner container 6 has been removed, the light-blocking member 73 needs to be retracted. In other words, if the output voltage Va of the light-receiving portion 72 increases after it is detected that the waste-toner container 6 has been removed from the printer 1, it can be determined that the waste-toner container 6 is attached to the printer 1. Thus, in the printer 1 according to this embodiment, the storage unit 93 stores a threshold Vth2 for detecting whether or not the waste-toner container 6 is attached to the printer 1 with respect to the output voltage Va of the light-receiving portion 72 (see FIG. 9). Then, the CPU 91 (control unit 9) compares the output voltage Va with the threshold Vth2 to determine whether or not the waste-toner container 6 is attached to the printer 1.

Hardware Configuration of the Image Forming Apparatus

Figure 7:
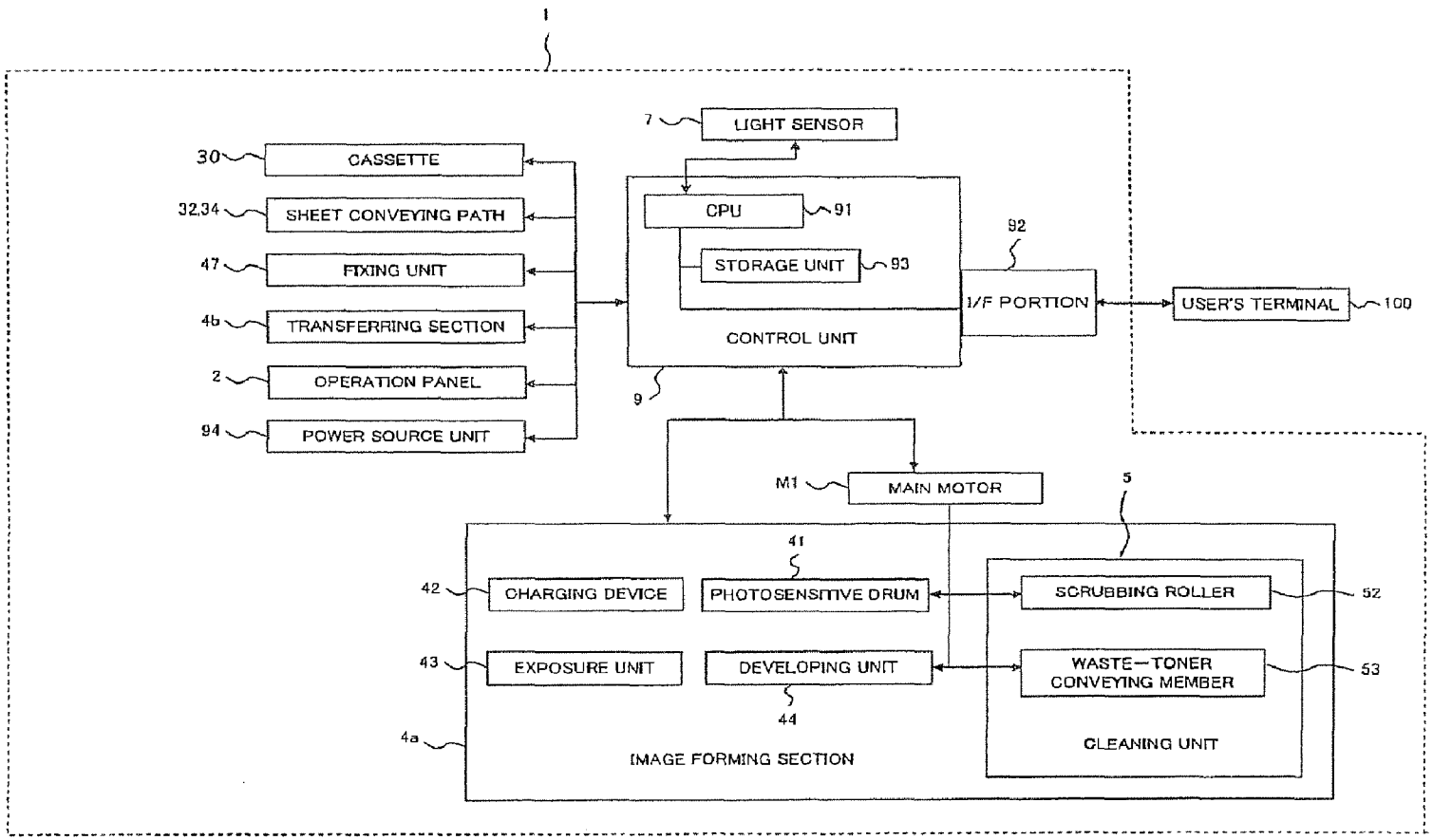
FIG. 7 is a block diagram of the printer according to an embodiment of the present invention.

Referring to FIG. 7, the hardware configuration of the printer 1 according to an embodiment of the present invention will be described. FIG. 7 is a block diagram of the printer 1 according to an embodiment of the present invention.

As shown in FIG. 7, the printer 1 according to this embodiment includes, in the main body, the image forming section 4*a* and the control unit 9 for controlling the operation of the printer 1 and receiving the output voltage Va of the light-receiving portion 72. The control unit 9 includes the CPU 91, an I/F portion 92, and the storage unit 93. The CPU 91 performs various calculations based on the programs and data stored in or inputted to the storage unit 93, controls the respective parts of the printer 1, and performs the various detections.

The storage unit 93 includes memories, such as a random access memory (RAM), a hard disk drive (HDD), and a flash read-only memory (flash ROM). The storage unit 93 can store controlling programs, data, image data, setting information of the printer 1, and the like in a non-volatile manner and can extract them. Furthermore, regarding implementation of the present invention, the storage unit 93 stores the programs for performing the various detections using the light sensor 7, the threshold Vth1 (first threshold) for detecting whether or not the waste-toner container 6 is full, the threshold Vth2 (second threshold) for detecting whether the light-blocking member 73 is retracted or projected, and the threshold Vth3 (third threshold) for detecting the outside light due to the side surface cover 1*a* being open, with respect to the output voltage Va of the light-receiving portion 72.

The I/F portion 92 is an interface that has several types of connectors and sockets, and allows the user's terminal 100, functioning as an external computer, to be connected to the printer 1 in a manner allowing communication either directly or via a network. The control unit 9 of the printer 1 receives image data or printing setting data from the user's terminal 100, and performs image formation. For convenience's sake, FIG. 7 shows only one user's terminal 100, although a plurality of user's terminals 100 may, of course, be connected to the printer 1. The control unit 9 is connected to the respective parts of the printer 1 via an I/O port (not shown) and a bus (not shown), and controls the operations of the cassette 30, the sheet conveying paths 32 and 34, the image forming section 4*a*, the transferring section 4*b*, the operation panel 2, the light sensor 7, the fixing unit 47, and the like.

In particular, regarding the image forming section 4*a*, the control unit 9 controls and instructs electrical operations of the charging device 42, the exposure unit 43, and the developing unit 44 (charging, laser output of the exposure unit 43, and bias of the developing unit 44). The control unit 9 also performs the on/off control of a main motor M1 that supplies the power for rotating the photosensitive drum 41, the scrubbing roller 52 of the cleaning unit 5, the waste-toner conveying member 53, and the like. For example, during printing, the control unit 9 turns the main motor M1 on to rotate the photosensitive drum 41, the scrubbing roller 52, and the waste-toner conveying member 53.

Furthermore, in the present invention, the control unit 9 (CPU 91) controls the light-emitting portion 71 (LED 71*a*) of the light sensor 7. In addition, when it is determined the waste-toner container 6 is full, the control unit 9 stops sheet feeding, the image forming section 4*a*, and the rotation of the scrubbing roller 52 and the waste-toner conveying member 53. Until the control unit 9 detects that the waste-toner container 6 has been replaced, the printer 1 is maintained in a non-printable state.

Control from the Detection of Fullness of Waste-Toner Container to Recovery

Figure 8A:
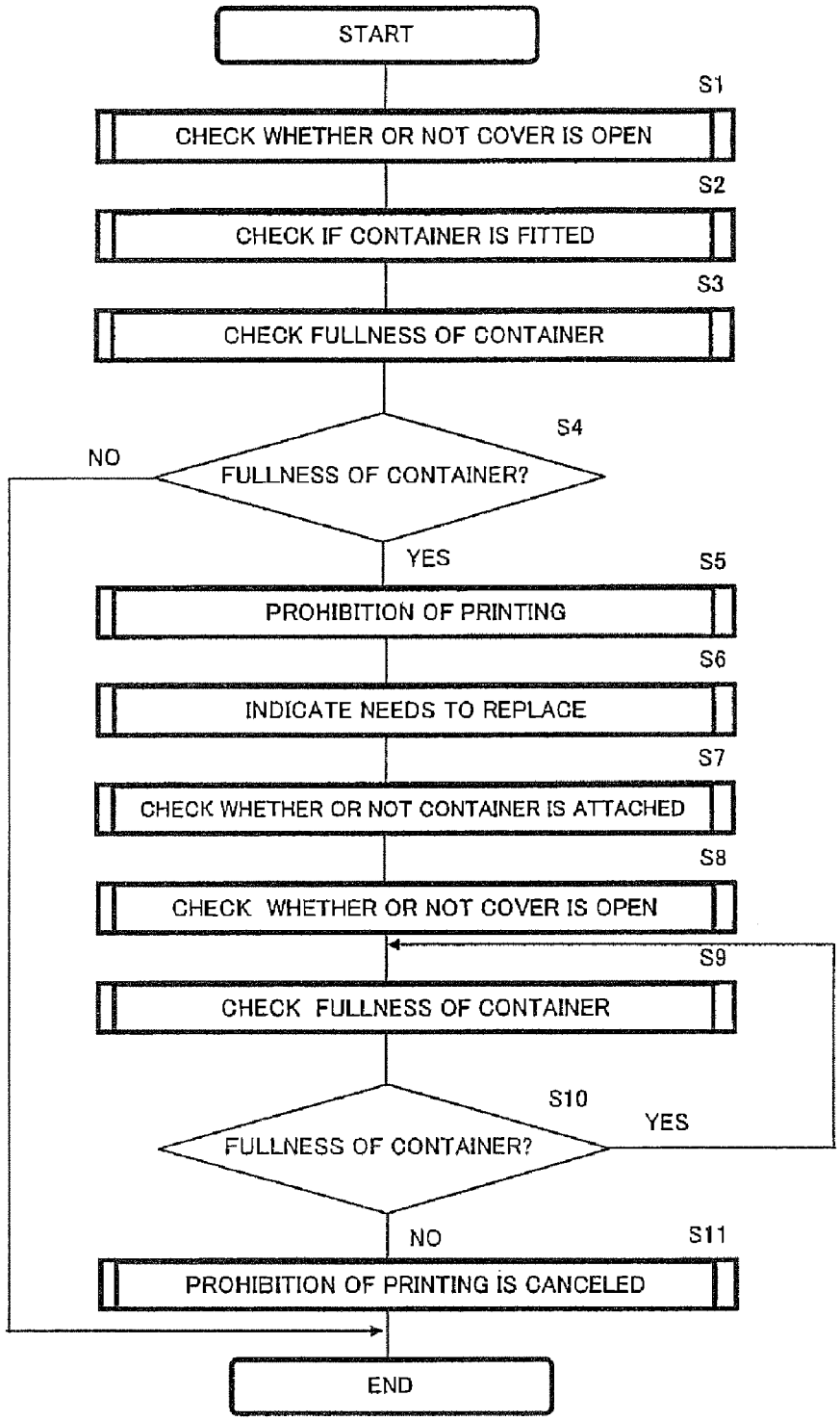
FIG. 8A is a flowchart of a main routine for controlling the process from the detection of the fullness of the waste-toner container to recovery according to an embodiment of the present invention.
Figure 8B:
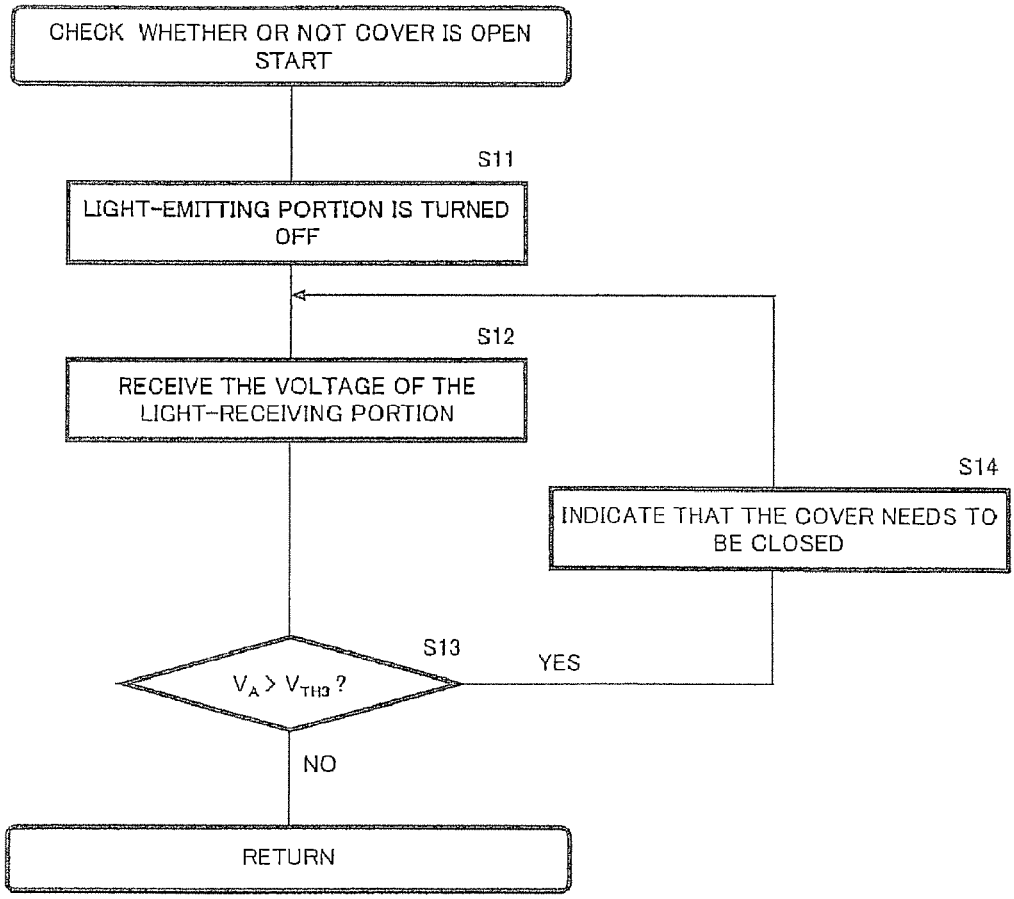
FIG. 8B is a flowchart of a subroutine for detecting whether or not the cover is open according to the embodiment.
Figure 8C:
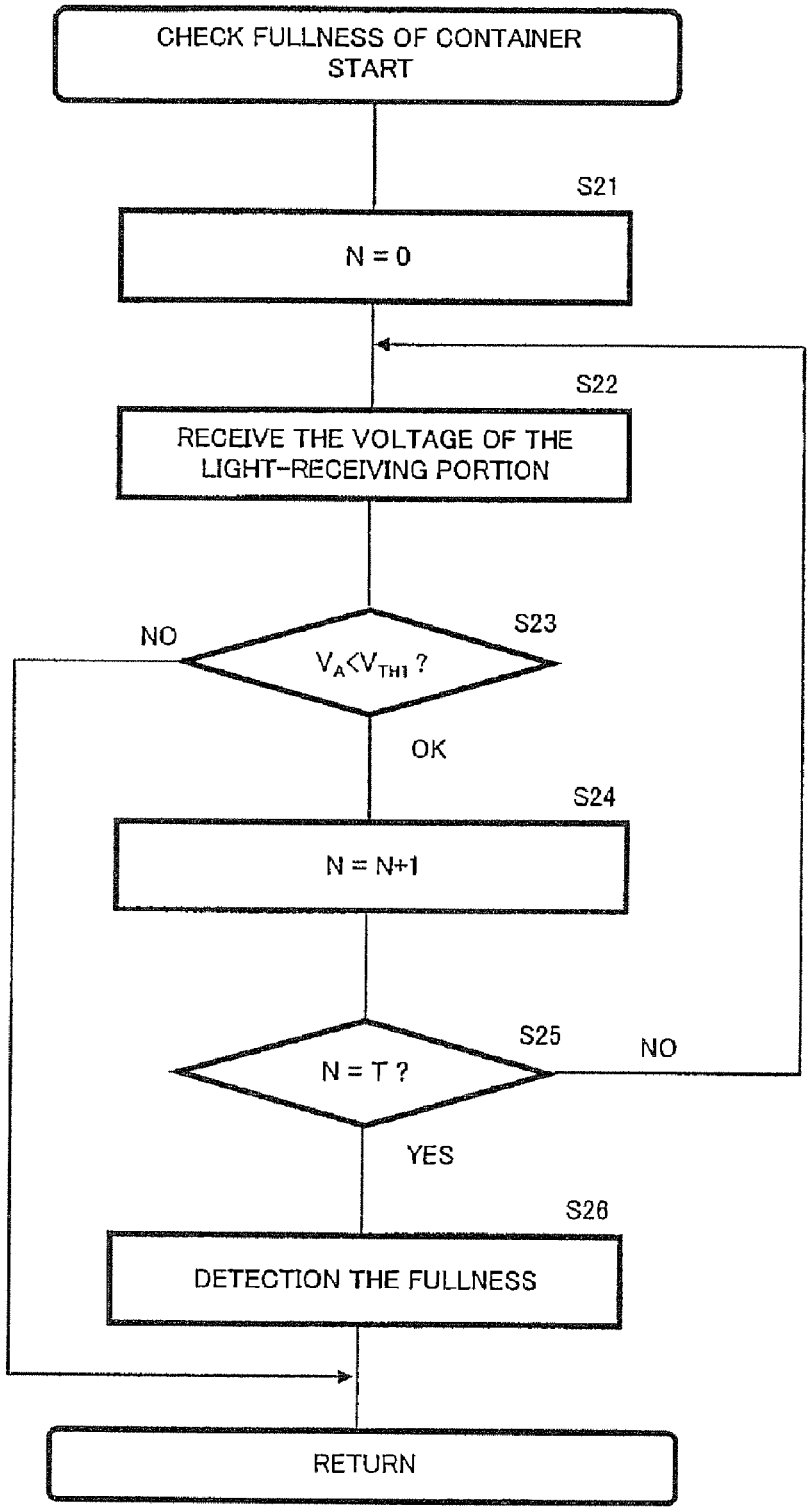
FIG. 8C is a flowchart of a subroutine for controlling the detection of the fullness of the waste-toner container according to the embodiment.
Figure 8D:
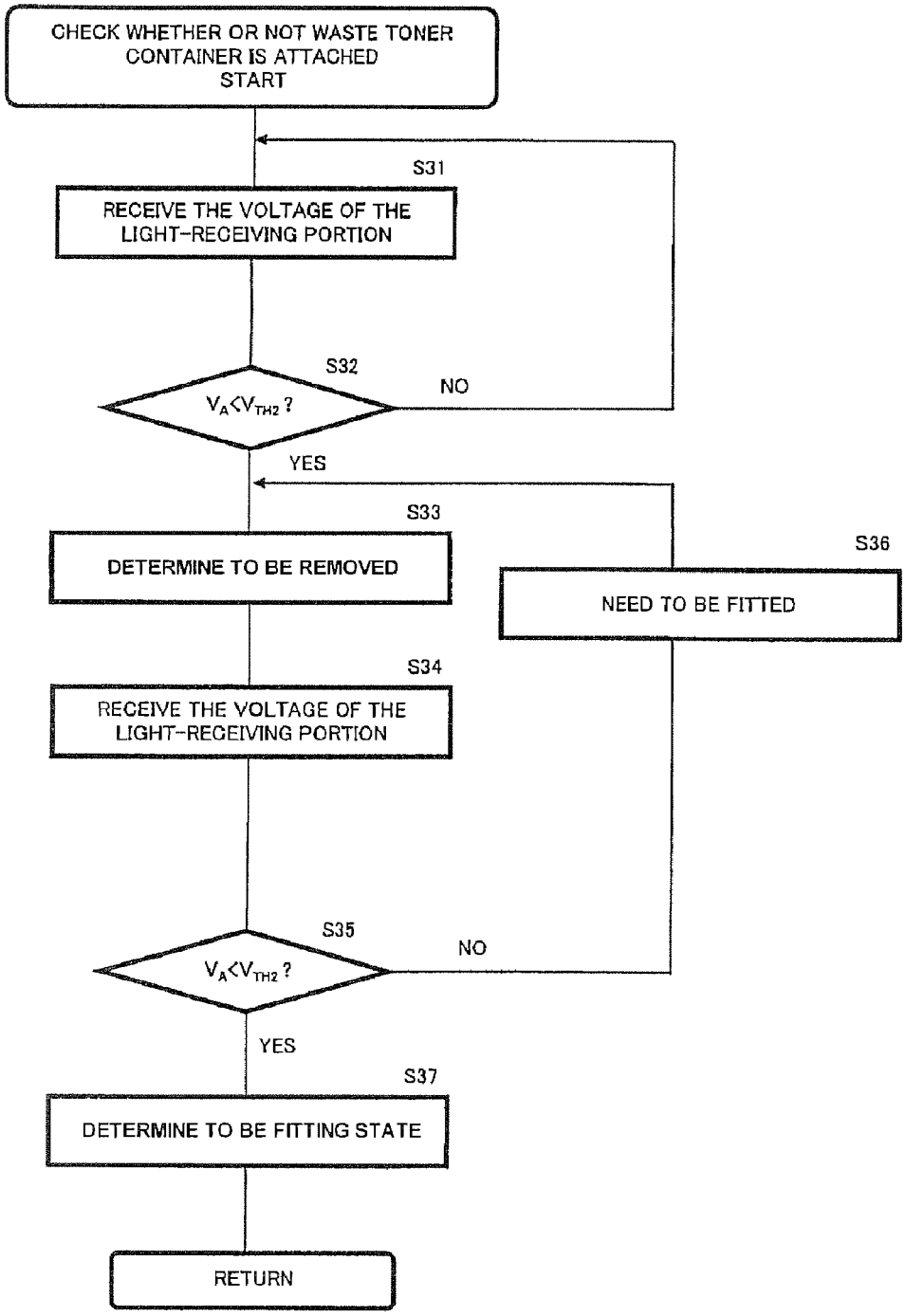
FIG. 8D is a flowchart of a subroutine for controlling the detection of whether or not the waste-toner container is attached to the printer according to the embodiment.
Figure 8E:
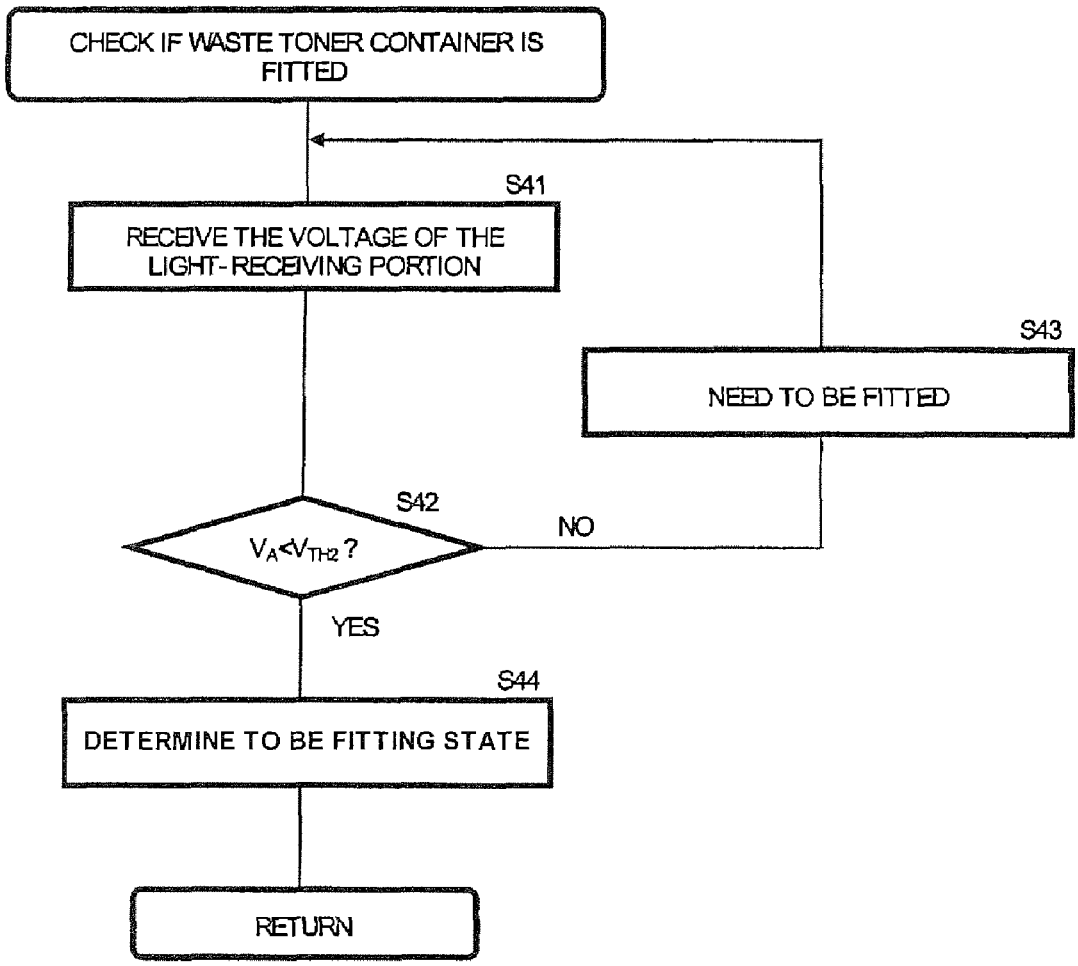
FIG. 8E is a flowchart of a subroutine for controlling the detection of if the waste-toner container is fitted to the printer according to an embodiment.

Referring to FIGS. 8A to 10B, control from the detection of the fullness of the waste-toner container 6 to recovery of the printer 1 according to an embodiment of the present invention will be described. FIG. 8A is a flowchart of a main routine for controlling the process from the detection of the fullness of the waste-toner container 6 to recovery, according to an embodiment of the present invention. FIG. 8B is a subroutine for detecting whether or not the side surface cover 1*a* is open. FIG. 8C is a subroutine for controlling the detection of the fullness of the waste-toner container 6. FIG. 8D is a subroutine for controlling the detection of whether or not the waste-toner container 6 is attached to the printer 1. FIG. 8E is a subroutine for controlling the detection of if the waste-toner container 6 is fitted to the printer 1.

Figure 10A:
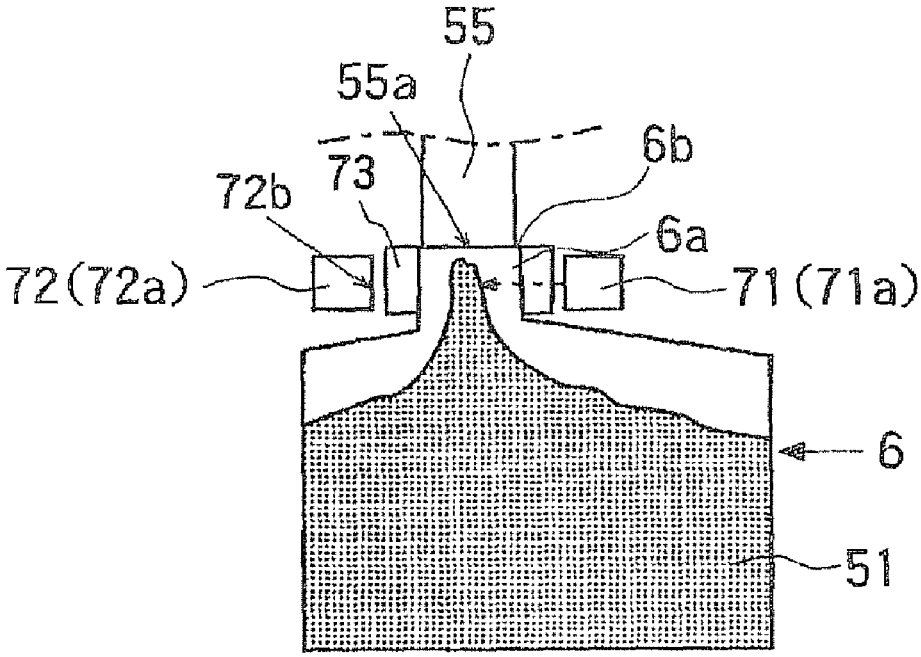
FIG. 10A illustrates the toner piled in the waste-toner container according to an embodiment.
Figure 10B:
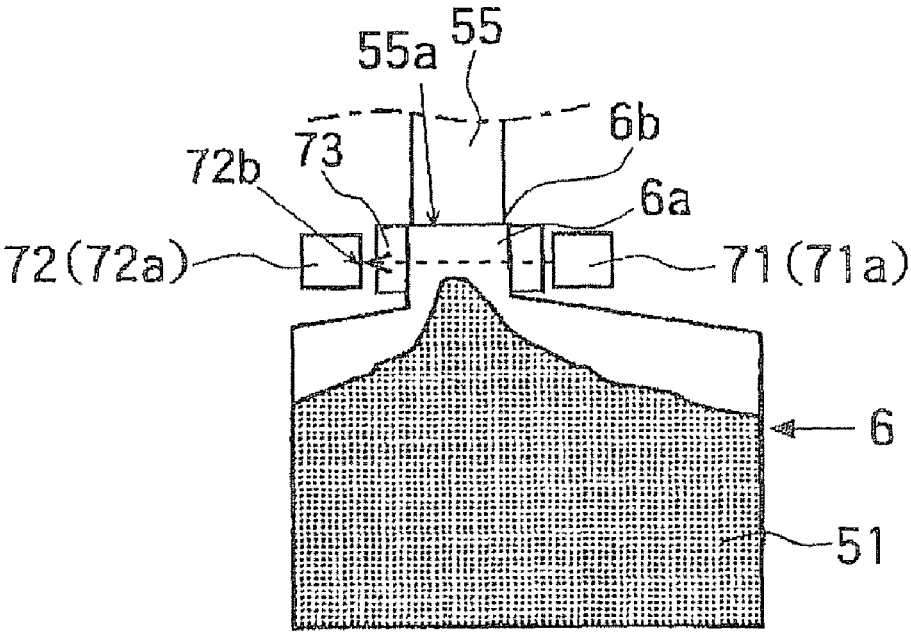
FIG. 10B illustrates the toner piled in the waste-toner container according to an embodiment.

FIG. 9 shows a relationship between thresholds used for the various detections in the printer 1 and output voltages Va of the light-receiving portion 72, according to an embodiment of the present invention. FIGS. 10A and 10B illustrates toner piled in the waste-toner container 6, according to an embodiment of the present invention.

The flowchart in FIG. 8A starts with turning-on the power source of the printer 1. Then, the control unit 9 (CPU 91) detects whether or not the side surface cover 1*a* is open (step S1). More specifically, according to the flowchart of the subroutine for detecting whether or not the side surface cover 1*a* is open (shown in FIG. 8B), after the light-emitting portion 71 is turned off (step S11), the control unit 9 receives the output voltage Va of the light-receiving portion 72 (step S12) and compares it with the threshold Vth3 for detecting the outside light (detecting whether or not the cover is open) (step S13) ((1) in FIG. 9). If the output voltage Va of the light-receiving portion 72 is greater than the threshold Vth3 (Va>Vth3), it is determined that the light-receiving portion 72 is receiving outside light. Thus, it is determined that the side surface cover 1*a* is open. In this manner, the control unit 9 detects whether or not the side surface cover 1*a* is open by comparing the output voltage Va of the light-receiving portion 72 when the light-emitting portion 71 is turned off with the threshold Vth3 (third threshold). When the control unit 9 confirms that the side surface cover 1*a* is open (step S13—Yes), the control unit 9 causes the operation panel 2 to display a message indicating that the side surface cover 1*a* needs to be closed (step S14) (for example, a message "please close the cover" is displayed on the liquid crystal display 22). Then, the process returns to step S12.

If the side surface cover 1*a* is closed (step S13—No), the process returns to the main routine (FIG. 8A).

Then, the control unit 9 detects whether or not the waste-toner container 6 is attached to the printer 1 (step S2). More specifically, according to the flowchart of the subroutine for detecting whether or not the waste-toner container is attached to the printer 1, shown in FIG. 8E, the control unit 9 causes the light-emitting portion 71 to emit light, receives the output voltage Va of the light-receiving portion 72 (step S41), and compares received output voltage Va with the threshold Vth2 for determining whether or not the waste-toner container 6 is attached to the printer 1. If the received output voltage Va of the light-receiving portion 72 is less than the threshold Vth2, it is determined that the waste-toner container 6 is attached to the printer 1, and the process returns to the main routine (step S42—Yes, S44). If the output voltage Va is greater than the threshold Vth2, the control unit 9 determines that the waste-toner container 6 has been removed from the printer 1 (step S42—No), requesting the user to attach the waste-toner container 6 to the printer 1 (step S43).

Next, the control unit 9 detects whether or not the waste-toner container 6 is full by causing the light-emitting portion 71 to emit light (step S3). More specifically, in the subroutine for detecting the fullness of the waste-toner container 6 shown in FIG. 8C, the control unit 9 sets a numerical number N=0 (step 21) and receives the output voltage Va of the light-receiving portion 72 when the light-emitting portion 71 emits light (step S22) and compares the received output voltage Va with the threshold Vth1 for detecting the fullness of the waste-toner container 6 (step S23), ((2) and (3) in FIG. 9). If the waste-toner container 6 is not full, the light from the light-emitting portion 71 reaches the light-receiving portion 72, making the output voltage Va greater than the threshold Vth1 ((2) in FIG. 9). In this situation, the control unit 9 determines that the waste-toner container 6 is not full, and the process returns to the main routine (step S23—No). If the waste toner 51 somewhat blocks the optical path from the light-emitting portion 71 to the light-receiving portion 72, the output voltage Va is less than the threshold Vth1 (step S23—Yes), ((3) in FIG. 9). In this situation, the waste-toner container 6 is determined to be full.

At this time, if the waste-toner container 6 is determined to be full (step S23—Yes), whether or not such determination has been made a predetermined number of times (for example, from four to less than twenty), is confirmed and the control unit 9 adds 1 to the numerical number N (steps S24 and S25). This is to avoid detection error. If such determination has not been made a predetermined number of times (step S25—No), the process returns to step S22. If such determination has been made a predetermined number of times (step S25—Yes), the waste-toner container 6 is determined to be full (step S26), and the process returns to the main routine.

If the waste-toner container 6 is determined to be full (step S4—Yes), the control unit 9 puts the printer 1 into a non-printable state (step S5) and indicates a message on the operation panel 2 or the like (step S6), requesting the user to check and replace the waste-toner container 6. For example, in the situation during printing, subsequent printing is aborted and the waste-toner conveying member 53 is stopped. In addition, the user is notified that the waste-toner container 6 has been determined to be full by a message such as "CHECK WASTE TONER BOX" displayed on the liquid crystal display 22.

Then, the control unit 9 confirms whether or not the user removed and then attached the waste-toner container 6 from and to the printer 1 (step S7). More specifically, as shown in the subroutine for detecting whether or not the waste-toner container is attached to the printer 1 (FIG. 8D), first, the control unit 9 receives the output voltage Va of the light-receiving portion 72 (step S31). If the waste-toner container 6 is removed from the printer 1 at this time, the light-blocking member 73 is projected to the second position, which significantly reduces the outside light or the light from the light-emitting portion 71 incident on the light-receiving portion 72. The control unit 9 compares the output voltage Va of the light-receiving portion 72 with the threshold Vth2 for detecting whether or not the waste-toner container 6 is attached to the printer 1. If the output voltage Va of the light-receiving portion 72 is less than the threshold Vth2 (step S32—Yes), it is determined that the light-blocking member 73 is projected to the second position, that is, the waste-toner container 6 has been removed from the printer 1 (step S33) ((6) in FIG. 9).

Next, once removal of the waste-toner container 6 from the printer 1 is confirmed, the control unit 9 detects whether or not the waste-toner container 6 is attached to the printer 1 (steps S34 to S37). More specifically, if the waste-toner container 6 is attached to the printer 1, the light-blocking member 73 is retracted to the first position. This increases the outside light or the light from the light-emitting portion 71 incident on the light-receiving portion 72. Thus, the control unit 9 compares the output voltage Va of the light-receiving portion 72 with the threshold Vth2, and, if the output voltage Va of the light-receiving portion 72 is greater than the threshold Vth2 ((7) in FIG. 9), it is determined that the waste-toner container 6 is attached to the printer 1 and the light-blocking member 73 is retracted to the first position. If the control unit 9 cannot confirm that the waste-toner container 6 is attached to the printer 1 (step S35—No), the control unit 9 provides a message requesting the user to attach the waste-toner container 6 to the printer 1 (step S36). Then, the process returns to step S33, and the control unit 9 waits until the waste-toner container 6 is attached to the printer 1.

In contrast, if the control unit 9 confirms that the waste-toner container 6 is attached to the printer 1 (step S35—Yes), the process returns to the main routine.

Then, as in step S1, the control unit 9 determines if the side surface cover 1*a* is closed (step S7). After confirming that the side surface cover 1*a* is closed, the control unit 9 determines whether or not the waste-toner container 6 is full (steps S8 and S9).

If the waste-toner container 6 is not full (step S10—No), it is determined that the waste-toner container 6 has been replaced with a new container. Then, the control unit 9 puts the printer 1 into a printable state again, and terminates the message requesting the user to check and replace the waste-toner container 6 (step S11). On the other hand, if the waste-toner container 6 is again determined to be full (step S10—Yes), it is determined that the waste-toner container 6 has not been replaced with a new container. Because this can cause behaviors of the printer 1 that can lead the user to believe the printer 1 is malfunctioning, the process returns to step S8 to recommend the user to replace the waste-toner container 6.

As has been described, when the control unit 9 of the printer 1 according to this embodiment has detected that the waste-toner container 6 is full, by referring to the output voltage Va of the light-receiving portion 72 and the storage unit 93, the control unit 9 causes the printer 1 to abort printing or prohibits the printer 1 from starting printing until the control unit 9 detects that the light-blocking member 73 is projected to the second position, then the light-blocking member 73 is retracted to the first position, and the waste-toner container 6 is not full. In other words, once the waste-toner container 6 is determined to be full, the printer 1 does not return to a printable state until the waste-toner container 6 is replaced.

Referring to FIG. 9, the relationship between the thresholds will now be described. As described above with reference to FIG. 6, the light-receiving portion 72 of this embodiment comprises the phototransistor 72*a*, whose output voltage Va varies according to the amount of light received. In this embodiment, the possible value of the output voltage Va is in the range from about 0 V to Vcc2. Because the fullness of the waste-toner container 6 is detected by detecting whether or not the waste toner 51 piled in a cone shape blocks part of the optical path from the light-emitting portion 71 to the light-receiving portion 72, the threshold Vth1 for the fullness detection can be set to a value of about 40% to 70% of Vcc taking into consideration the properties of the waste toner 51, such as fluidity, reflectance, and absorptivity.

The threshold Vth2 for detecting whether the waste-toner container 6 is attached to the printer 1 (the light-blocking member 73 is retracted) or the waste-toner container 6 has been removed from the printer 1 (the light-blocking member 73 is projected) is determined by how effectively the light-blocking member 73 blocks light incident on the light-receiving portion 72. Normally, the threshold Vth2 is set to be less than the threshold Vth1. This is because, since the light-blocking member 73 blocks light so as to cover the light-receiving surface 72*b*, the light-blocking member 73 more effectively blocks light than the waste toner 51. That is, the output voltage Va of the light-receiving portion 72 increases as the amount of light received increases. Thus, the threshold Vth1 (first threshold) is greater than the threshold Vth2 (second threshold).

The threshold Vth3 for detecting whether or not the side surface cover 1*a* is open (for detecting the outside light) may be greater than the threshold Vth2. Taking into consideration, when the waste-toner container 6 is full or nearly full, the fact that the waste toner 51 blocks the outside light incident on the light-receiving portion 72, the threshold Vth3 may be less than the threshold Vth1. However, because this may be affected by the size of the opening of the side surface cover 1*a* or the orientation of the light-receiving surface 72*b* of the light-receiving portion 72, the relationship between the threshold Vth1 and the threshold Vth3 may be determined based on the data obtained through experiments.

Elimination of Behaviors Leading to User's Misconception

Referring to FIGS. 10A and 10B, elimination of the behaviors leading to a user's misconception occurring when determining whether or not the waste-toner container 6 is full will now be described. FIGS. 10A and 10B illustrate toner piled in the waste-toner container 6, according to an embodiment of the present invention.

Usually, once the waste-toner container 6 is determined to be full, the printer 1 is put into a non-printable state until the waste-toner container 6 is replaced in order to prevent members for feeding the waste toner 51 from being damaged or waste toner 51 from being spilled. In other words, the printer 1 is then maintained in a non-printable state until the waste-toner container 6 is determined not to be full.

As shown in FIG. 10A, because the waste toner 51 is in powder form, the waste toner 51 in the waste-toner container 6 is piled in the shape of a cone (in the shape of an inverted funnel) with the apex located near the bottom of the conveying tube 55. Then, as shown in FIG. 10A, when the apex of the piled waste toner 51 reaches the optical path from the light-emitting portion 71 to the light-receiving portion 72, the waste-toner container 6 is determined to be full.

However, even if the waste-toner container 6 is detected to be full, as shown in FIG. 10B, the apex of the piled waste toner 51 sometimes collapses due to various factors such as the vibrations caused when the printing operation is stopped, the vibrations applied to the printer 1, the waste toner 51 newly fallen from the conveying tube 55, and the weight of the waste toner 51 itself. As a result, the waste toner 51 then does not block the optical path from the light-emitting portion 71 to the light-receiving portion 72, leading to a determination that the waste-toner container 6 is not full. A conventional printer 1 may determine that waste-toner container 6 has been replaced.

When it is determined that the waste-toner container 6 has been replaced, the printer 1 returns to a printable state. However, even if the printer 1 returns to a printable state, because the waste-toner container 6 is almost full, the waste-toner container 6 is soon thereafter determined to be full, bringing the printer 1 again into a non-printable state. In an extreme instance, the printer 1 may alternate between a non-printable state and a printable state at each one-paper printing operation. If the printer 1 alternates between a non-printable state and a printable state at short intervals, a user may misconceive that the printer 1 is malfunctioning or has failed.

To avoid such a misconception, typically, it is determined whether or not the cover (the side surface cover 1*a* in this embodiment), which is opened and closed when the waste-toner container 6 is replaced, is open. That is, once the waste-toner container 6 is determined to be full, the printer 1 is maintained in a non-printable state until it is detected that the side surface cover 1*a* is opened and then closed. In other words, the printer 1 returns to a printable state only when the side surface cover 1*a* is closed. Another reason for this is to prevent the photosensitive drum 41 from being exposed by the outside light (to prevent degradation in the image quality) and improve safety.

In general, a switch, such as an interlock switch, is used to determine whether or not the side surface cover 1*a* is open. However, such a switch (sometimes a relatively large, expensive switch is used, taking into consideration durability) requires wiring and space, increasing the production costs of the printer 1.

Unlike conventional image forming apparatus, the printer 1 according to this embodiment does not require a switch for detecting whether or not the side surface cover 1*a* is open (there is no need to provide the switch). Although production costs can be reduced by eliminating the interlock switch, behaviors of the printer 1 leading to a user's misconception may occur after it is determined the waste-toner container 6 is full since the detection by the switch of whether or not the side surface cover 1*a* is open cannot be used as a condition for cancelling the non-printable state. However, in the printer 1 according to this embodiment, whether or not the side surface cover 1*a* is open is also detected with the light sensor 7, using the outside light. Accordingly, even if a switch for detecting whether or not the side surface cover 1*a* is open is not provided, once it is determined the waste-toner container 6 is full, the printer 1 can be returned to a printable state after it is definitely confirmed that the side surface cover 1*a* is opened, the waste-toner container 6 is replaced, and then the side surface cover 1*a* is closed.

As has been described, with the configuration according to the above-described embodiment, once it is determined the waste-toner container 6 is full, a non-printable state is maintained until the waste-toner container 6 is replaced. Thus, even if the toner piled in the waste-toner container 6 collapses, the printer 1 does not voluntarily return to a printable state. For example, after having been maintained in a non-printable state because the waste-toner container 6 was detected to be full, the printer 1 does not voluntarily return to a printable state and the printing operation is repeatedly stopped and restarted during continuous printing. Thus, there is no user's misconception that the printer 1 is malfunctioning or failed. Furthermore, the detection of whether or not the waste-toner container 6 is full and the detection of whether or not the waste-toner container 6 is attached to the printer 1 can be performed in a clearly distinguished manner, using the threshold Vth1 (first threshold) and the threshold Vth2 (second threshold).

Because not only does the light sensor 7 detect the fullness of the waste-toner container 6 and whether or not the waste-toner container 6 is attached to the printer 1, but also whether or not the side surface cover 1*a* is open, there is no need to provide a switch, such as an interlock switch, to determine whether or not the side surface cover 1*a* is open. This reduces the number of components provided on the printer 1, and can significantly reduce the production costs. A user may forget to close the side surface cover 1*a* after the user opens the side surface cover 1*a* to replace the waste-toner container 6. Because the outside light is incident on the light-receiving portion 72 when the side surface cover 1*a* is open, whether or not the waste-toner container 6 is full cannot be accurately detected. If printing is performed while the side surface cover 1*a* is open, the outside light is incident on the photosensitive drum 41, possibly affecting the quality of the image being formed. However, in this design, because the detection of whether or not the waste-toner container 6 is full is performed after it is confirmed that the side surface cover 1*a* is closed, the detection of whether or not the waste-toner container 6 is full can be accurately performed. Furthermore, because recovery from the non-printable state is performed after it is confirmed that the side surface cover 1*a* is closed, degradation in image quality can be prevented. While the light-blocking member 73 blocks light so as to cover the light-receiving portion 72, the piled waste toner 51 usually blocks only part of the optical path from the light-emitting portion 71 to the light-receiving portion 72. With this design, however, because the first threshold is greater than the second threshold, the light sensor 7 can clearly distinguish the situation in which the waste-toner container 6 is filled with the waste toner 51 from the situation in which the waste-toner container 6 has been removed from the printer 1.

The present invention is usable in image forming apparatuses having a waste-toner container and a cover through which the waste-toner container is attached.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. An image forming apparatus comprising:

an image forming section that forms an image using toner;

a discharge port for discharging waste toner from the image forming section;

a cover capable of being opened and closed, the cover constituting a part of a casing of the image forming apparatus;

a translucent waste-toner container having an opening for receiving the waste toner discharged from the discharge port and being attached to the casing at a position where it is exposed to ambient conditions when the cover is open;

a light sensor having a light-emitting portion and a light-receiving portion whose output voltage varies according to an amount of light received, the light-emitting portion and the light-receiving portion being positioned so as to oppose each other with the opening being located therebetween;

a light-blocking member that is projectable and retractable between the light-emitting portion and the light-receiving portion, the light-blocking member being retracted when the waste-toner container is attached to the image forming apparatus and projecting to block light when the waste-toner container is removed from the image forming apparatus;

a storage unit that stores an output voltage from the light-receiving portion for detecting a fullness of the waste-toner container as a first threshold, an output voltage from the light-receiving portion for detecting whether or not the light-blocking member is projected as a second threshold and an output voltage of the light-receiving portion for detecting outside light entering due to the cover being opened as a third threshold; and a control unit for controlling operation of the image forming section based on the output voltage of the light-receiving portion, when the control unit has determined that the waste-toner container is full, by referencing the output voltage of the light-receiving portion and the storage unit, the control unit prohibits printing and does not permit the image forming apparatus to perform printing until the control unit detects that the light-blocking member is projected, the light-blocking member is then retracted, and the waste-toner container is not full and the control unit detects whether or not the cover is open by comparing an output voltage of the light-receiving portion when the light-emitting portion is turned off with the third threshold.

2. The image forming apparatus according to claim 1, wherein the control unit detects the fullness of the waste-toner container after the control unit detects that the cover is closed.

3. The image forming apparatus according to claim 1, wherein the control unit prohibits a printing operation when the control unit has detected a predetermined number of times that the waste-toner container is full by referring to the output voltage of the light-receiving portion and the storage unit.

4. The image forming apparatus according to claim 1, wherein the light sensor is a photo interrupter wherein the light-receiving portion is a phototransistor and the light-emitting portion is a light-emitting diode.

5. The image forming apparatus according to claim 1, wherein the output voltage of the light-receiving portion increases as the amount of light received increases, and, the first threshold is greater than the second threshold.

6. A method for detecting a fullness of a waste-toner container in an image forming apparatus using a light sensor having a light-emitting portion and a light-receiving portion, the method comprising the steps of:

detecting the fullness of the waste-toner container by comparing a first threshold, which is an output voltage of the light-receiving portion with which the waste-toner container is regarded as being full, with a received output voltage;

prohibiting printing when the waste-toner container is determined to be full;

detecting whether or not the waste-toner container is removed and is then attached again by providing a light-blocking member that is retracted when the waste-toner container is attached to the image forming apparatus and is projected when the waste-toner container is not attached to the image forming apparatus, and comparing the received output voltage with a second threshold, which is an output voltage of the light-receiving portion when the light-blocking member blocks light from the light-emitting portion;

detecting whether or not a cover is open by comparing a third threshold, which is an output voltage of the light-receiving portion for detecting the outside light entering due to the cover being opened, with the output voltage of the light-receiving portion, the process proceeds to the step of detecting the fullness when the cover is detected to be closed; and permitting printing when the attachment and removal of the waste-toner container are detected and then the waste-toner container is determined not to be full.

7. The method according to claim 6, wherein, in the step of detecting the fullness, the waste-toner container is determined to be full only after the waste-toner container has been detected to be full a predetermined number of times.

8. A method for detecting a fullness of a waste-toner container in an image forming apparatus using a light sensor having a light-emitting portion and a light-receiving portion, the method comprising the steps of:

detecting the fullness of the waste-toner container by comparing a first threshold, which is an output voltage of the light-receiving portion with which the waste-toner container is regarded as being full, with a received output voltage;

prohibiting printing when the waste-toner container is determined to be full;

detecting whether or not the waste-toner container is removed and is then attached again by providing a light-blocking member that is in a first position when the waste-toner container is attached to the image forming apparatus and is moved to a second position when the waste-toner container is not attached to the image forming apparatus, and comparing the received output voltage with a second threshold, which is an output voltage of the light-receiving portion when the light-blocking member is in the second position;

detecting whether or not a cover is open by comparing a third threshold, which is an output voltage of the light-receiving portion for detecting the outside light entering due to the cover being opened, with the output voltage of the light-receiving portion, the process proceeds to the step of detecting the fullness when the cover is detected to be closed; and permitting printing when the attachment and removal of the waste-toner container are detected and then the waste-toner container is determined not to be full.

* * * * *